US007137720B1

(12) United States Patent
Finkle

(10) Patent No.: US 7,137,720 B1
(45) Date of Patent: Nov. 21, 2006

(54) LIQUID MOTION LAMP

(76) Inventor: Louis J. Finkle, 3300 E. 59th St., Long Beach, CA (US) 90805

( * ) Notice: Subject to any disclaimer, the term of this patent is extended or adjusted under 35 U.S.C. 154(b) by 72 days.

(21) Appl. No.: 10/856,457

(22) Filed: Jun. 1, 2004

(51) Int. Cl.
*F21V 9/12* (2006.01)
*F21V 33/00* (2006.01)
*G09F 19/00* (2006.01)

(52) U.S. Cl. ..... 362/318; 362/101; 362/96; 40/406; 40/409

(58) Field of Classification Search ..... 362/318, 362/96, 101, 811, 562; 40/406, 407, 409; 446/267
See application file for complete search history.

(56) References Cited

U.S. PATENT DOCUMENTS 3,387,396 A * 6/1968 Smith ..... 40/406
3,570,156 A 3/1971 Walker ..... 40/106.21
4,419,283 A 12/1983 Schneider ..... 252/600
5,778,576 A * 7/1998 Kaviani ..... 40/409
6,604,835 B1 8/2003 Zale ..... 362/101
6,681,508 B1 1/2004 Unger et al. ..... 40/406
6,746,131 B1 * 6/2004 Goldstein et al. ..... 362/96
2003/0202340 A1 * 10/2003 Wu ..... 362/101

* cited by examiner

*Primary Examiner*—John Anthony Ward
*Assistant Examiner*—David Makiya
(74) *Attorney, Agent, or Firm*—Kenneth L. Green; Edgar W. Averill, Jr.

(57) ABSTRACT

An improved liquid motion lamp includes a second heat source to reduce warm-up time and a removable base cover to simplify changing a first heat source. The first heat source is preferably a light bulb residing in the base of the lamp, which light bulb provides both heat to cause motion of liquids within the lamp, and light to enhance a viewing effect. The sliding cover is preferably an open ended cylinder which slides upwards to provide access to the light bulb. The liquids comprises a first liquid which is a solid at room temperature and which is preferably paraffin based, and a second liquid which is preferably water. The first liquid may be empirically determined by mixing trial batches of paraffin and chlorinated paraffin to determine the correct ratio for a given lot of paraffins. The first liquid may be prepared, and shipped with the lamp in a solid phase. The second liquid may be added at the lamp's final destination.

20 Claims, 5 Drawing Sheets

LIQUID MOTION LAMP

BACKGROUND OF THE INVENTION

The present invention relates to decorative lighting and in particular to a liquid motion lamp.

Liquid motion lamps, commonly called "lava lamps" have been know since the 1960s. Such lamp is described in U.S. Pat. No. 3,387,396 for "Display Devices." The '396 patent describes a lamp having globules of a first liquid suspended in a second liquid, wherein the first liquid has a thermal expansion coefficient providing sufficient expansion, and therefore reduction in density, such that the first liquid is heavier than the second liquid at a lower temperature, and lighter than the second liquid at a higher temperature. The temperatures may be, for example 45 degrees Centigrade and 50 degrees Centigrade. The first and second liquids are contained in a clear container having a heat source at the bottom, and as a result, the first liquid is heated, rises within the second liquid, cools, and drops back to the bottom of the container. At least one of the liquids is preferably colored, and provides an entertaining motion for an observer. Lamps such as described by the '396 patent are typically small and are sold as a sealed unit.

Recently, liquid motion lamps have gained popularity, and there is a desire to use such lamps in various commercial settings, for example hotel lobbies, clubs, lounges, etc. Unfortunately, simply scaling up known liquid motion lamps results in a product very expensive to ship, and which require as much as an eight hour or more warm-up period before use.

BRIEF SUMMARY OF THE INVENTION

The present invention addresses the above and other needs by providing an improved liquid motion lamp including a second heat source to reduce warm-up time and a removable base cover to simplify changing a first heat source, and further, a method for manufacturing the lamp allows filling with liquid after shipment of the lamp. A first heat source is preferably at least one light bulb residing in the base of the lamp, which light bulb provides both heat to cause motion of liquids within the lamp, and light to enhance a viewing effect. The sliding cover is preferably an open ended cylinder which slides upwards to provide access to the light bulb. The liquids comprises a first liquid which is preferably paraffin based, and a second liquid which is preferably water. The ratio of ingredients of the first liquid may be empirically determined by mixing trial batches of paraffin and chlorinated paraffin to determine the correct ratio for a given lot of paraffins. The specific gravity of the resulting mixture may be measured and compared to a desired specific gravity, and the result of the comparison used to adjust the ratio of the ingredients in the mixture. After determining the ratio, the first liquid may be prepared, and shipped with or in the lamp. The second liquid may be added at the lamp's final destination.

In accordance with one aspect of the invention, there is provided a liquid motion lamp comprising a container, a first liquid suitable for residing in the container, a base portion substantially below the container, the base portion including a heat source within the base portion and a base cover. It is to be understood that the first liquid is a solid at room temperature and becomes a liquid after heating, as the lamp is in use. The first liquid is adapted to cooperate with a second liquid, which second liquid is a liquid at room temperature, and which first liquid has a greater density than the second liquid at room temperature, and a lower density than the second liquid at a second and higher temperature, and which second liquid is a liquid at the second temperature. The base cover may be moved to replace the heat source without disturbing the container, and the heat source provides sufficient heat to maintain liquid motion of the first liquid within the second liquid. The lamp may further include a second heat source for reducing the time required to bring the lamp to operating temperature.

In accordance with another aspect of the present invention, a method for preparing a liquid motion lamp for shipping is described, wherein the final filling of liquid into the lamp may be done after shipping. The method comprises adding a first amount of paraffin to a second amount of chlorinated paraffin to create a mixture. The Specific Gravity (SG) of the mixture is measured, preferably at the operating temperature of the lamp, and more preferably at approximately 135 degrees Fahrenheit. The SG is compared to a lower limit SG1. If SG is not greater than a lower limit SG1, the first amount is increased (or the second amount in decreased) and the method is restarted. Otherwise, the SG is compared to an upper limit SG2. If SG is not less than the upper limit SG2, the first amount is decreased (or the second amount is increased) and the method is restarted. If SG is greater than the lower limit SG1 and less than the upper limit SG2, a quantity of a first liquid is prepared based on the first amount and the second amount. An appropriate amount of the first liquid is added to a container of, or provided with, a liquid motion lamp. If the first liquid is added to the container, it is added in a fluid state and allowed to cool and solidify for shipping. The lamp containing the solidified first liquid is shipped, and a second liquid is added after the lamp is at it's final destination.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

Figure 1:
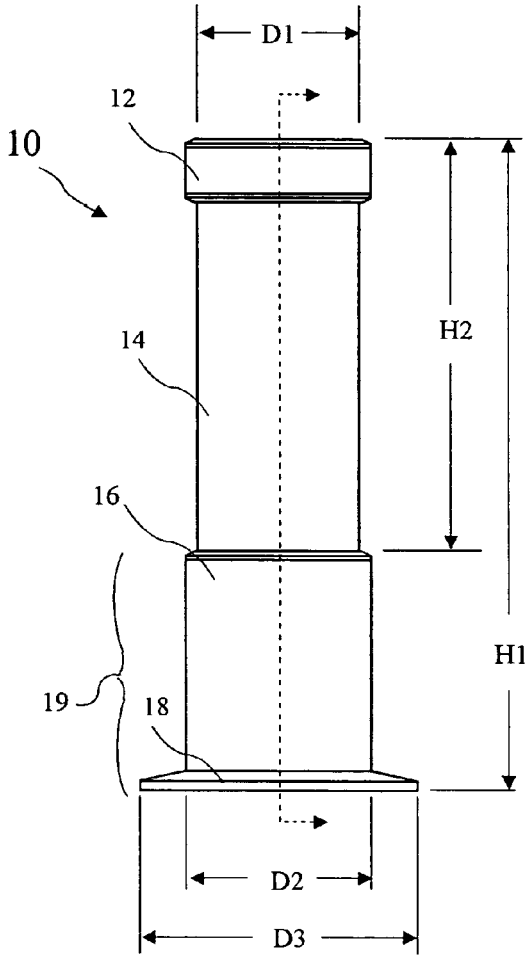
FIG. 1 is liquid motion lamp according to the present invention.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Liquid motion lamps, or lava lamps, are well known as small home decorative lighting. U.S. Pat. No. 3,387,396 for "Display Devices," U.S. Pat. No. 3,570,156 for "Display Devices," and U.S. Pat. No. 5,778,576 for "Novelty Lamp," describe such lamps. A detailed description of liquids used in such lamps is provided in U.S. Pat. No. 4,419,283 for "Liquid compositions for display devices." The '396, '156, '576, and '283 patents are herein incorporated by reference.

Although basic home lava lamps have become commonplace, large versions for commercial use have not been entirely practical for various reasons. The liquid motion lamp 10 shown in FIG. 1 overcomes these obstacles. The lamp 10 includes a top piece 12, a container 14, and a base portion 19 including a base cover 16 and a base flange 18. The container 14 is preferably transparent and more preferably made from boro silicate glass or any clear stable plastic, for example, acrylic or poly carbonate. The top piece 12, base cover 16, and base flange 18 are preferably made from cast aluminum. The container 14 preferably extends into the base portion 19, and preferably, at least a portion of the base portion 19 is below the bottom of the container 14.

Figure 2:
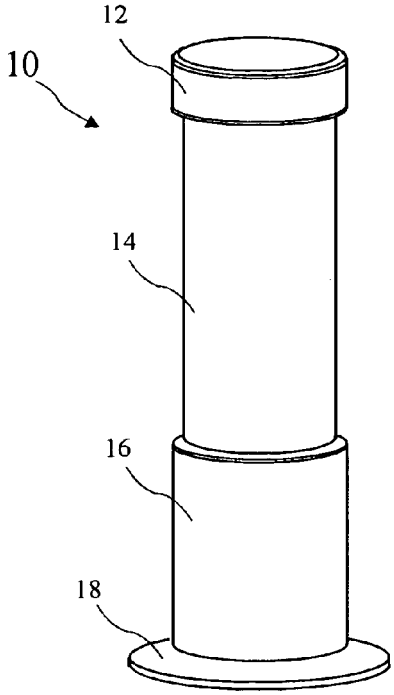
FIG. 2 shows a perspective view of the liquid motion lamp.

The container 14 diameter D1 is preferably be between six inches and 36 inches, the base cover diameter D2 is preferably between approximately one inch and approximately two inches greater than the container diameter D1, and the base flange diameter D3 is preferably between approximately two inches and approximately twelve inches greater than the container diameter D1. The overall height H1 of the lamp 10 is between approximately three feet and approximately nine feet, and the height H2 of the visible portion of the container 14 is preferably between approximately two feet and approximately six feet While the primary advantages of the present invention are directed to a lamp 10 having the preferred dimensions, any lamp including the present invention described herein is intended to come within the scope of the present invention. A perspective view of the lamp 10 is shown in FIG. 2.

Figure 3A:
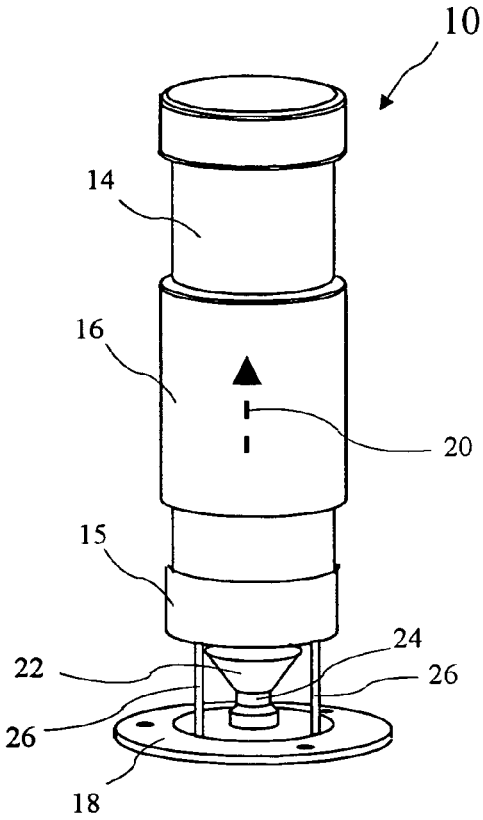
FIG. 3A shows the liquid motion lamp with a base cover raised to gain access to a first heating element.
Figure 3B:
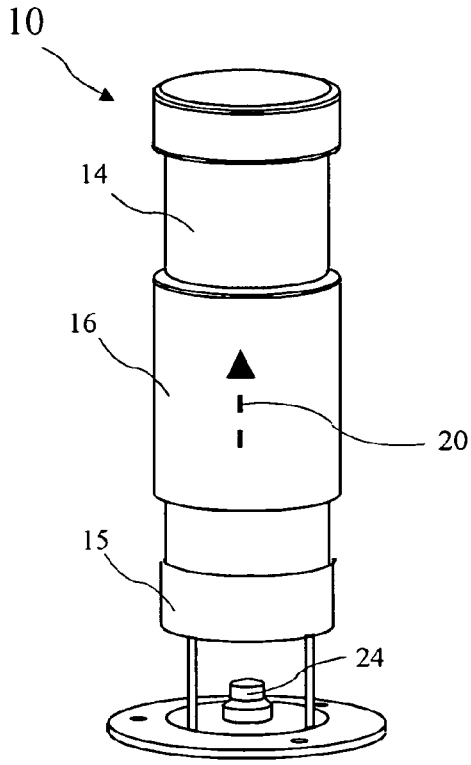
FIG. 3B shows the liquid motion lamp with a base cover raised and with the first heating element removed.

A lamp 10 intended for use in a commercial setting, for example, hotel lobbies, clubs, lounges, etc., may be much larger and heavier than known lava lamps. As a result, it is not practical to lift or move the lamp 10 to replace a heat source which has failed. To address replacement of the heat source, the base cover 16 is vertically moveable along an arrow 20 as shown in FIG. 3A. With the base cover 16 raised, a first heat source 22 is accessible. The heat source 22 is preferably also a light source, and is more preferably an incandescent light bulb. The heat source 22 is electrically and mechanically connected to a socket 24. A view of the lamp 10 with the heat source 22 removed is shown in FIG. 3B. The container 14 is supported by supports 26 residing between the base flange 18 and the container 14. There are preferably three supports 26, and a container base 15 proximal to the bottom of the container 14.

Figure 4:
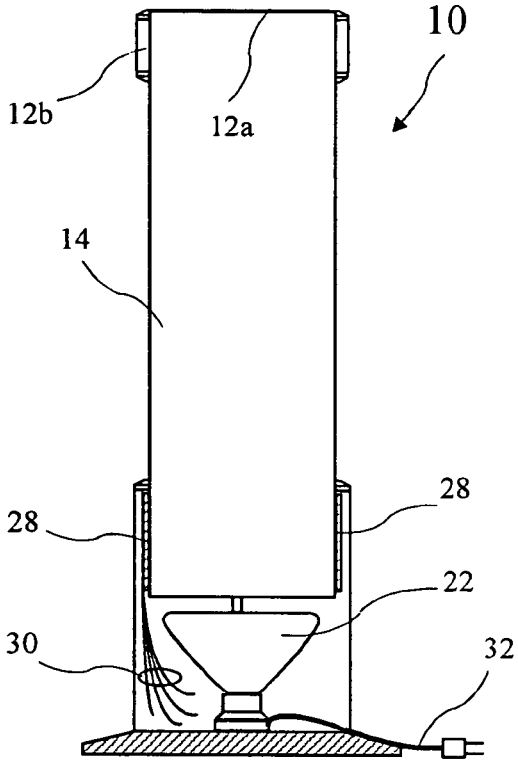
FIG. 4 shows a cross-sectional view of the liquid motion lamp taken along line 4—4 of FIG. 1, showing a second heating element.

A cross-sectional view of the lamp 10 taken along line 4—4 of FIG. 1 is shown in FIG. 4. An edge view of the second heat source 28 is shown circling the container 14. The second heat source 28 preferably resides in or on a portion of the container 14 normally covered by the base cover 16. The second heat source 28 may be potted to the container 14, and may be a heat blanket, and preferably an approximately 250 watt to approximately 500 watt heat blanket. The heat source 28 is further preferably a dual filament heat blanket with configurable wiring 30 allowing the second heat source to be wired for 2 voltage levels, and more preferably for approximately 120 volts and for approximately 240 volts. The top piece 12 comprises a round cover 12*a* for the container 14 and a short cylindrical portion 12*b* for positioning the top piece 12 on the container 14. The top piece 12 is preferably fabricated from the same material as the base cover 16 and the base flange 18, and preferably provides a moisture proof seal to the container 14.

While a single first heat source 22 comprising a single light is shown in FIG. 4, the first heat source 22 may comprise one, two, three, or more lights, for example, a single 175 watt light, or three 150 watt lights. Further, the present invention may be practiced without a second heat source 28, thereby impacting the start-up time, but not the operation of the lamp 10. The first heat source 22 and the second heat source 28 or 28*a* preferably receive electrical power through a power cord 32.

Figure 4B:
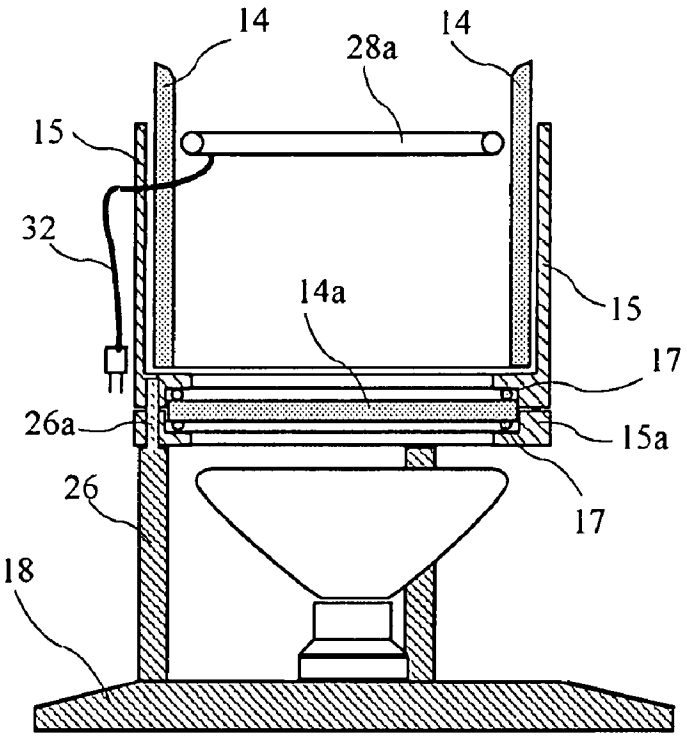
FIG. 4B is a detailed view of the bottom portion of the cross-sectional view of the liquid motion lamp taken along line 4—4 of FIG. 1, showing bottom sealing details and a second heat source comprising a circular heating element suitable for immersion in the second liquid.
Figure 4A:
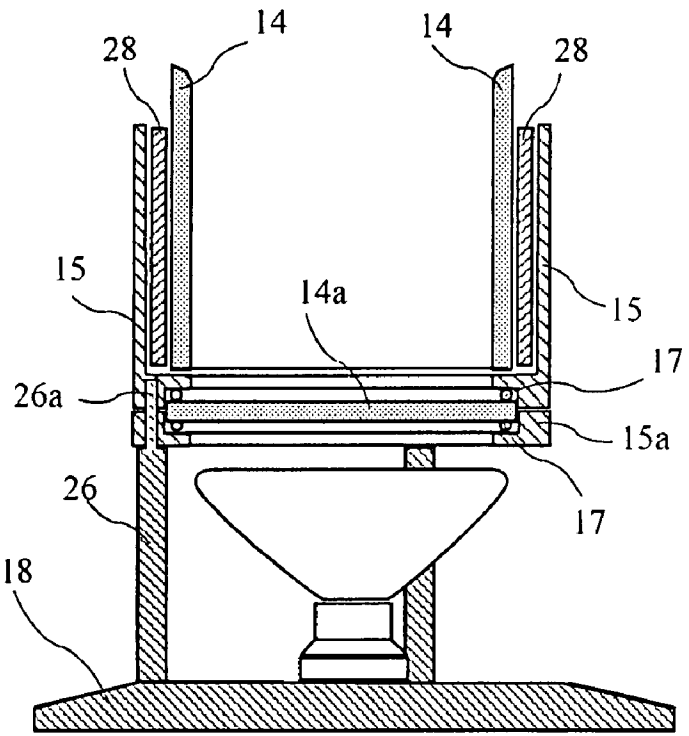
FIG. 4A is a detailed view of a bottom portion of the cross-sectional view of the liquid motion lamp taken along line 4—4 of FIG. 1, showing bottom sealing details and a second heat source residing on the exterior of the container.

A detailed view of a bottom portion of the cross-sectional view of the liquid motion lamp taken along line 4—4 of FIG. 1 is shown in FIG. 4A showing bottom sealing details. A container base 15 surrounds and supports the bottom of the container 14. The container base 15 is somewhat L shaped and reached under a lower edge of the container 14 to provide vertical support. The base 15 cooperates with a base ring 15*a* to form a seal between a container bottom 14*a* and the container 14. The container bottom 14*a* is preferable fabricated from a transparent material to pass light from the heat source 22 into the container 14, and the container bottom 14*a* is more preferably made from the same material as the container 14.

The container bottom 14*a* is sandwiched between the base 15 and the base ring 15*a*, and O-rings 17 reside on the top and bottom of the container bottom 14*a* to form a seal between the container bottom 14*a* and the base 15, and between the container bottom 14*a* and the base ring 15*a*. The second heat source 28 preferably resides between the base 15 and the container 14, and is preferably potted in place. The supports 26 (see FIGS. 3A, 3B) are attached to the base 15 using support studs 26*a*, passing through the base ring 15*a*, thereby joining the base ring 15*a* to the base 15, and compressing O-rings 17.

A detailed view of the bottom portion of the cross-sectional view of the liquid motion lamp taken along line 4—4 of FIG. 1, showing bottom sealing details and another preferred second heat source comprising a circular heating element 28*a* suitable for immersion in the second liquid is shown in FIG. 4B. The heating element 28*a* resides inside the container 14 and receives power through heating element wires 36. The heating element 28*a* has an outside diameter slightly smaller than an inside diameter of the container 14, and there is preferably an approximately 0.25 inch gap between the heating element 28*a* and the container 14 inside surface, and is positioned vertically to be concealed by the base cover 16 (see FIG. 1) when the base cover 16 is lowered over the base portion 19, and/or is positioned vertically to be concealed by the base ring 15. The heating element 28*a* is preferably an approximately 750 watt to approximately 1500 watt heating element.

Figure 5:
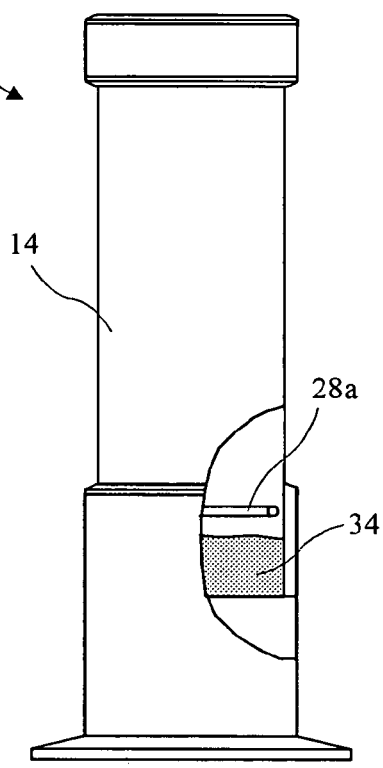
FIG. 5 shows the liquid motion lamp with a first liquid in solid form residing in the bottom of a container portion.

When the lamp 10 is in use, the container 14 is substantially filled with two immiscible liquids. The lamp 10 is shown in cut-away in FIG. 5 with the first liquid 34 residing in the bottom of the container 14, which first liquid 34 is preferably a solid at room temperature and preferably reside behind the base cover 16 when solidified, and is preferable below the heating element 28*a* when solidified. The second liquid (not shown) is preferably liquid at room temperature and more preferably comprises water. The first liquid 34 has greater density than the second liquid at room temperature. When heated to operating temperature, the first liquid 34 becomes less dense than the second liquid and rises in the container 14, thereby creating liquid motion. As the first liquid 34 rises in the container 14, the first liquid 34 cools sufficiently to become more dense than the second liquid, and thus drops back to the bottom of the container 14 where the first liquid 34 is again heated. The lamp preferably operates at between approximately 130 degrees Fahrenheit and approximately 135 degrees Fahrenheit.

An exemplar first liquid 34 is a paraffin based thermally expansive material, and preferably a combination of chlorinated paraffin and paraffin. The paraffin is preferably a low melting temperature paraffin, and more preferably a low oil content paraffin, and most preferably a less than three percent oil content paraffin, also known as a scale wax. The paraffin is preferable a low melting temperature paraffin to allow a low operating temperature for the lamp. A surfactant is preferably added to the container to reduce surface tension of the liquids, and a binder is preferably added to prevent the paraffin and chlorinated paraffin from separating. The surfactant is preferably a high cloud point surfactant, and the binder is preferably Polyboost binder made by Hase Petroleum Wax Co. in Arlington Heights, Ill.

Figure 6:
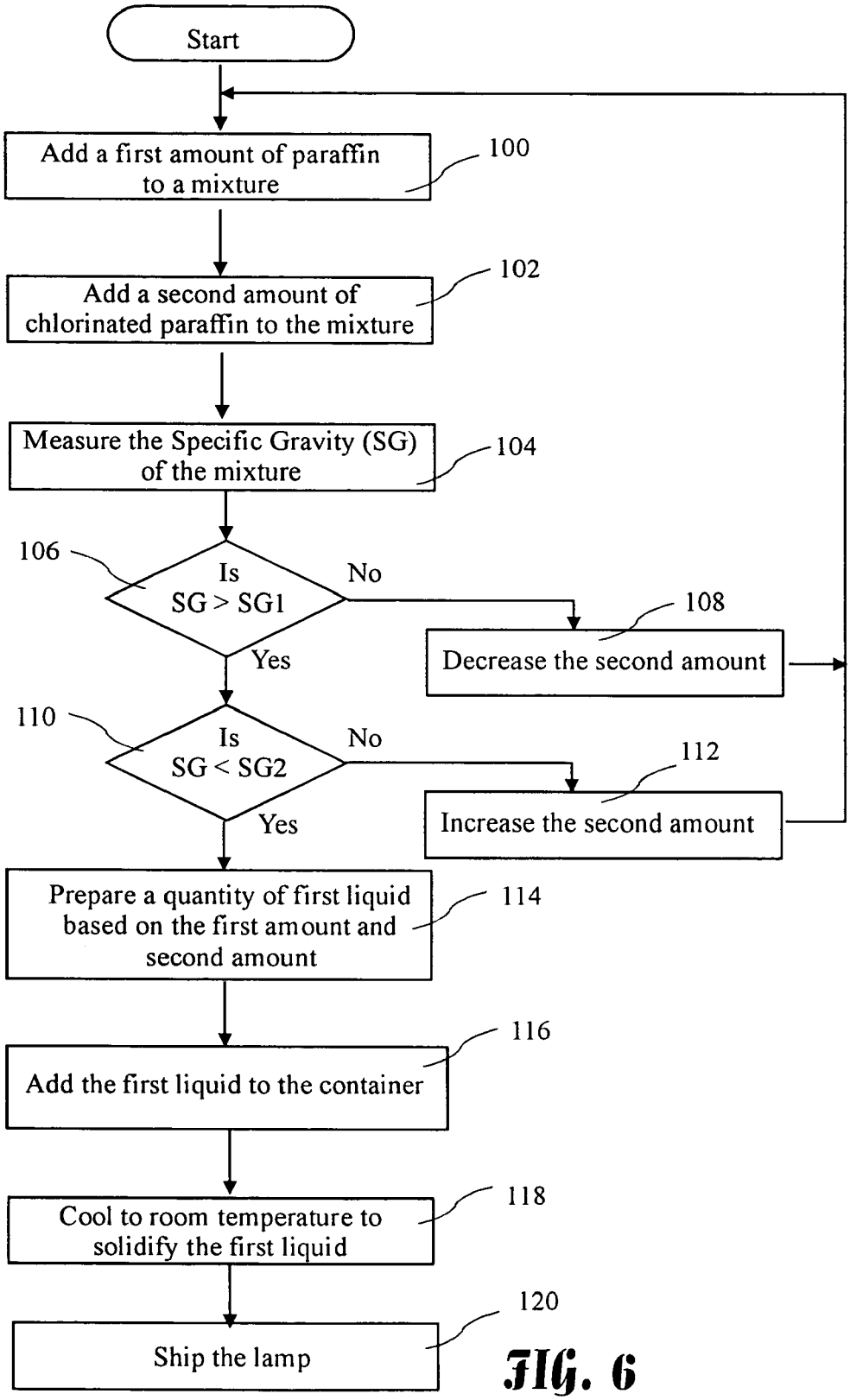
FIG. 6 describes a method for preparing a liquid motion lamp for shipment.

A method for preparing the lamp 10 for shipping is described in FIG. 6. Generally, the specific density of paraffins varies from lot to lot. As a result, a single formula for mixing the paraffin and chlorinated paraffin is not available, and the ratio of paraffin to chlorinated paraffin must be determined empirically for each lot of material received. A preferred method comprises adding a first amount of paraffin to a mixture at step 100 and adding a second amount of chlorinated paraffin to the mixture at step 102. The Specific Gravity (SG) of the mixture is measured at step 104. The SG is compared to a lower limit SG1 at step 106. If SG is not greater than a lower limit SG1, the second amount is decreased at step 108 and the method is restarted. The SG is compared to an upper limit SG2 at step 110. If SG is not less than the upper limit SG2, the second amount is increased at step 112 and the method is restarted. If SG is greater than the lower limit SG1 and less than the upper limit SG2, a quantity of the first liquid 34 is prepared based on the first amount and the second amount at step 114. An appropriate amount of the first liquid 34 may be added to the container 14 (see FIG. 5) of, or provided with, a liquid motion lamp 10 at step 116. The lamp 10 containing the first liquid 34 in a solid room temperature phase is shipped at step 118. A preferred starting first amount and second amount are approximately 100 units and 200 units respectively.

Other methods for determining a ratio of paraffin to chlorinated paraffin may be used, for example, measuring the specific density or other characteristics of the paraffin and/or chlorinated paraffin, and computing a mixing ratio, or making a trial mixture and observing the behavior of the trial mixture in water. A first liquid 34 made by any method, and included with a lamp 10 for shipping without any second liquid, or with a reduced quantity of the second liquid, is intended to come within the scope of the present invention.

The method described in FIG. 6 may further include adding a binder to the mixture to prevent separation of the paraffin from the chlorinated paraffin, and/or adding a surfactant to the mixture. The surfactant is preferably a high cloud level surfactant. The specific gravity of the mixture is preferably measured using a pycno meter at elevated temperature, and preferably at lamp operating temperature, and more preferably at approximately 135 degrees Fahrenheit, and the lower limit SG1 is preferably approximately 0.995 and the upper limit SG2 is preferably approximately 0.998, although a wider range of specific gravity may be used with a higher power heat source.

Shipment without the second liquid substantially reduce the weight of the lamp 10, and makes shipping the lamp 10 much easier. The first liquid 34 may be colored during preparation, or coloring may be provided with the lamp 10 to be added after the lamp 10 is delivered to a customer. Preferably, a coloring provided to a customer is in a solid form, and preferably coloring of several different colors is provided.

While the invention herein disclosed has been described by means of specific embodiments and applications thereof, numerous modifications and variations could be made thereto by those skilled in the art without departing from the scope of the invention set forth in the claims.

I claim:

1. A liquid motion lamp suitable for shipping, comprising:

a container;

a first liquid suitable for residing in the container, which first liquid is a solid at room temperature and is a liquid at a second higher temperature, and which first liquid is adapted to cooperate with a second liquid, which second liquid is a liquid at room temperature, and which first liquid has a greater density than the second liquid at room temperature, and a lower density than the second liquid at the second temperature;

a base portion, at least a portion of which is below the container;

a first electrically powered heat source within the base portion; and a second electrically powered heat source adapted to be in thermal cooperation with at least one of the set consisting of the first liquid and the second liquid, wherein the first heat source provides sufficient heat to maintain liquid motion of the first liquid within the second liquid.

2. The liquid motion lamp of claim 1, wherein the container is transparent.

3. The liquid motion lamp of claim 2, wherein the container is made from a material selected from the group consisting of boro silicate glass and clear stable plastic.

4. The liquid motion lamp of claim 1, wherein the first heat source is also a light source.

5. The liquid motion lamp of claim 4, wherein the first heat source is an incandescent light bulb.

6. The liquid motion lamp of claim 5, wherein a base cover surrounds the base, and wherein the base cover may be moved to replace the incandescent light bulb without disturbing the container.

7. The liquid motion lamp of claim 6, wherein the base cover may be translated upwardly to replace the incandescent light bulb.

8. The liquid motion lamp of claim 1, wherein the second heat source is a heat blanket.

9. The liquid motion lamp of claim 1, wherein the second heat source is a heating element residing inside the container.

10. The liquid motion lamp of claim 1, wherein the container overlaps the base portion, and wherein the second heat source resides in the overlap.

11. The liquid motion lamp of claim 10, wherein the second heat source is between an approximately 750 watt and an approximately 1500 watt heat element.

12. The liquid motion lamp of claim 1, wherein the second liquid comprises water.

13. The liquid motion lamp of claim 1, wherein the first liquid comprises a mixture of chlorinated paraffin and paraffin.

14. A liquid motion lamp comprising:

a container;

a first liquid suitable for residing in the container, which first liquid is a solid at room temperature and a liquid at a lower operating temperature and a liquid at a higher operating temperature, and which first liquid is adapted to cooperate with a second liquid, which second liquid is a liquid at room temperature, and which first liquid has a greater density than the second liquid at the lower operating temperature and a lower density than the second liquid at the second operating temperature;

a base portion substantially below the container;

a heat source within the base portion; and a cylindrical base cover, wherein the base cover may be moved vertically to replace the heat source without disturbing the container, wherein the heat source provides sufficient heat to maintain liquid motion of the first liquid within the second liquid.

15. A method for preparing a liquid motion lamp for shipping, the method comprising:

adding a first amount of paraffin to a mixture;

adding a second amount of chlorinated paraffin to the mixture;

measuring the Specific Gravity (SG) of the mixture at a temperature sufficiently high to melt the mixture;

if SG is not greater than a lower limit SG1:

decreasing the second amount; and starting over;

if SG is not less than an upper limit SG2:

increasing the second amount; and starting over;

preparing a quantity of a first liquid based on the first amount and the second amount;

including the first liquid with a liquid motion lamp, which first liquid is in a solid phase at room temperature; and shipping the lamp.

16. The method of claim 15, further including adding a binder to the first liquid to prevent separation of the paraffin from the chlorinated paraffin.

17. The method of claim 15, further including adding a surfactant to the first liquid.

18. The method of claim 15, wherein measuring the specific gravity of the mixture comprises measuring the specific gravity using a pycno meter.

19. The method of claim 15, wherein the lower limit SG1 is approximately 0.995 and the upper limit SG2 is approximately 0.998 and the measuring the SG is at lamp operating temperature.

20. A method for shipping a liquid motion lamp, the method comprising:

preparing a quantity of a first liquid to obtain a desire specific gravity relative to a second liquid, wherein the first liquid is in a solid phase at room temperature and is in a liquid phase at a lamp operating temperature, and wherein second liquid is in a liquid phase at room temperature;

packaging the first liquid and the liquid motion lamp in a shipping container, wherein the contents of the shipping container consists essentially of solid phase material and gas phase material, whereby the shipping container contains substantially no liquid phase material;

transporting the shipping container to a final destination; and adding the second liquid to the liquid motion lamp at the final destination.

* * * * *